US007000415B2

(12) United States Patent
Daddis, Jr. et al.

(10) Patent No.: US 7,000,415 B2
(45) Date of Patent: Feb. 21, 2006

(54) FOUL-RESISTANT CONDENSER USING MICROCHANNEL TUBING

(75) Inventors: Eugene Duane Daddis, Jr., Manlius, NY (US); Robert H. L. Chiang, Shanghai (CN)

(73) Assignee: Carrier Commercial Refrigeration, Inc., Charlotte, NC (US)

( * ) Notice: Subject to any disclaimer, the term of this patent is extended or adjusted under 35 U.S.C. 154(b) by 0 days.

(21) Appl. No.: 10/835,031

(22) Filed: Apr. 29, 2004

(65) Prior Publication Data

US 2005/0241327 A1 Nov. 3, 2005

(51) Int. Cl.
*A47F 3/04* (2006.01)

(52) U.S. Cl. ..... 62/255; 62/507; 165/110; 165/152

(58) Field of Classification Search ..... 62/246–256, 62/506–508; 165/110, 152
See application file for complete search history.

(56) References Cited

U.S. PATENT DOCUMENTS 2,932,955 A * 4/1960 Hargrave et al. ..... 62/255
3,084,914 A * 4/1963 Davis ..... 165/61
3,462,968 A 8/1969 Puta et al.
RE29,438 E * 10/1977 MacCracken et al. ..... 165/46
4,332,293 A * 6/1982 Hiramatsu ..... 165/153
4,977,754 A 12/1990 Upton et al.
5,076,354 A * 12/1991 Nishishita ..... 165/146
5,458,190 A * 10/1995 Sasaki et al. ..... 165/110
RE35,742 E * 3/1998 Hoshino et al. ..... 165/150
5,765,393 A * 6/1998 Shlak et al. ..... 62/507
6,467,535 B1 * 10/2002 Shembekar et al. ..... 165/140

* cited by examiner

*Primary Examiner*—William E. Tapolcai
(74) *Attorney, Agent, or Firm*—Wall Marjama & Bilinski LLP

(57) ABSTRACT

A condenser coil for a refrigerated beverage and food service merchandiser includes a plurality of parallel fins between adjacent tubes. In order to reduce the likelihood of fouling by the bridging of fibers therebetween, the spacing of the fins is maintained at a distance of 0.4 to 0.8 inches apart. In one embodiment, the tubes comprise microchannel tubes, with no fins therebetween, and the spacing between the microchannel tubes is maintained in the range of 0.75 inches to optimize the heat transfer performance while minimizing the occurrence of fouling. A supporting structure is provided between microchannel tubes when no fins are included. Also, plural rows of microchannel tubes are provided with separate inlet headings and with the rows being staggered in transverse relationship to enhance the heat transfer characteristic while minimizing the likelihood of fouling.

31 Claims, 6 Drawing Sheets

FOUL-RESISTANT CONDENSER USING MICROCHANNEL TUBING

BACKGROUND OF THE INVENTION

This invention relates generally to refrigerated beverage and food service merchandisers and, more particularly, to a foul resistant condenser coil therefor.

It is long been the practice to sell soda and other soft drinks by way of vending machines or coin operated refrigerated containers for dispensing single bottles of beverages. These machines are generally stand alone machines that are plugged into standard outlets and include their own individual refrigeration circuit with both evaporator and condenser coils.

This self serve approach has now been expanded to include other types of "plug in" beverage and food merchandisers that are located in convenience stores, delicatessens, supermarkets and other retail establishments.

In such stores, cold beverages, such as soft drinks, beer, wine coolers, etc. are commonly displayed in refrigerated merchandisers for self-service purchase by customers. Conventional merchandisers of this type usually comprise a refrigerated, insulated enclosure defining a refrigerated product display cabinet and having one or more glass doors. The beverage product, typically in cans or bottles, single or in six-packs, is stored on shelves within the refrigerated display cabinet. To purchase a beverage, the customer opens one of the doors and reaches into the refrigerated cabinet to retrieve the desired product from the shelf.

Beverage merchandisers of this type necessarily include a refrigeration system for providing the cooled environment within the refrigerated display cabinet. Such refrigeration systems include an evaporator coil housed within the insulated enclosure defining the refrigerated display cabinet and a condenser coil and compressor housed in a compartment separate from and exteriorly of the insulated enclosure. Cold liquid refrigerant is circulated through the evaporator coil to cool the air within the refrigerated display cabinet. As a result of heat transfer between the air and the refrigerant passing in heat exchange relationship in the evaporator coil, the liquid refrigerant evaporates and leaves the evaporator coil as a vapor. The vapor phase refrigerant is then compressed in the compressor coil to a high pressure, as well as being heated to a higher temperature as a result of the compression process. The hot, high pressure vapor is then circulated through the condenser coil wherein it passes in heat exchange relationship with ambient air drawn or blown across through the condenser coil by a fan disposed in operative association with the condenser coil. As a result, the refrigerant is cooled and condensed back to the liquid phase and then passed through an expansion device which reduces both the pressure and the temperature of the liquid refrigerant before it is circulated back to the evaporator coil.

In conventional practice, the condenser coil comprises a plurality of tubes with fins extending across the flow path of the ambient air stream being drawn or blown through the condenser coil. A fan, disposed in operative association with the condenser coil, passes ambient air from the local environment through the condenser coil. U.S. Pat. No. 3,462,966 discloses a refrigerated glass door merchandiser having a condenser coil with staggered rows of finned tubes and an associated fan disposed upstream of the condenser coil that blows air across the condenser tubes. U.S. Pat. No. 4,977,754 discloses a refrigerated glass door merchandiser having a condenser coil with in-line finned tube rows and an associated fan disposed downstream of the condenser that draws air across the condenser tubes.

One problem that occurs with such self-contained merchandisers is that they are often in area that is heavily trafficked by people that tend to track in debris and dirt from the outside. This, in turn, tends to expose the condenser coil, which is necessarily exposed to the flow of air in the immediate vicinity, to be susceptible to airside fouling. With such fouling, the accumulation of dust, dirt and oils impede refrigeration performance. As the condenser coil fouls, the compressor refrigerant pressure rises, which leads to system inefficiencies and possibly compressor failure. Further, such products are often used in locations where periodic cleaning is not likely to occur.

The usual structure for such a condenser coil is a tube and fin design wherein a plurality of serpentine tubes with refrigerant flowing therein are surrounded by orthogonally extending fins over which the cooling air is made to flow by way of a fan. Generally, the greater the tube and fin densities, the more efficient the performance of the coil in cooling the refrigerant. However, the greater the tube and fin densities, the more susceptible it is to being fouled by the accumulation of dirt and fiber.

This problem has been addressed in one form by the elimination of fins and relying on conventional tubes as set forth in U.S. patent application Ser. No. 10/421,575, assigned to the assignee of the present application and incorporated herein by reference. A further approach has been to selectively stagger the successive rows of tubes in relation to the direction of airflow as described in U.S. Patent Application No. (PCT/US03/12468), Continuation In Part Application of Provisional Application Ser. No. 60/376,486 filed on Apr. 30, 2002, assigned to the assignee of the present application and incorporated herein by reference.

SUMMARY OF THE INVENTION

Briefly, in accordance with one aspect of the invention, the tube and fin condenser coil is replaced by a condenser coil having a greater number of microchannel tubes than the previous number of round tubes but, with the clearances from tube to tube being relatively large such that air side fouling is less likely to occur.

In accordance with another aspect of the invention, such a microchannel refrigerant tube is able to operate with lower amounts of refrigerant when compared to traditional round tube condensers, such that the additional tube surface that is required to make up for using less fins does not significantly increase refrigerant charge requirements.

By yet another aspect of the invention, the fin density of a microtubes condenser coil is reduced to a level which will substantially eliminate the bridging of fibers between fins such that the occurrence of fouling is substantially reduced or eliminated. If the fin density is reduced to the extent that there is little or no support between the microchannel tubes, then provision is made to include a support structure, in spaced relationship between the adjacent tubes to prevent movement and/or damage thereto.

In accordance with another aspect of the invention, in order to provide sufficient heat exchange surface area with the reduced tube and fin densities, multiple rows of microchannel tubes may be provided with each row having its own header. In order to obtain better heat exchange efficiencies without an attendant increase in fouling, the tubes rows are staggered such that the tubes from the downstream row are located so as to be substantially between the tubes of the upstream row.

In the drawings as hereinafter described, a preferred embodiment is depicted; however various other modifications and alternate constructions can be made thereto without departing from the true spirit and scope of the invention.

DESCRIPTION OF THE PREFERRED EMBODIMENT

Figure 1:
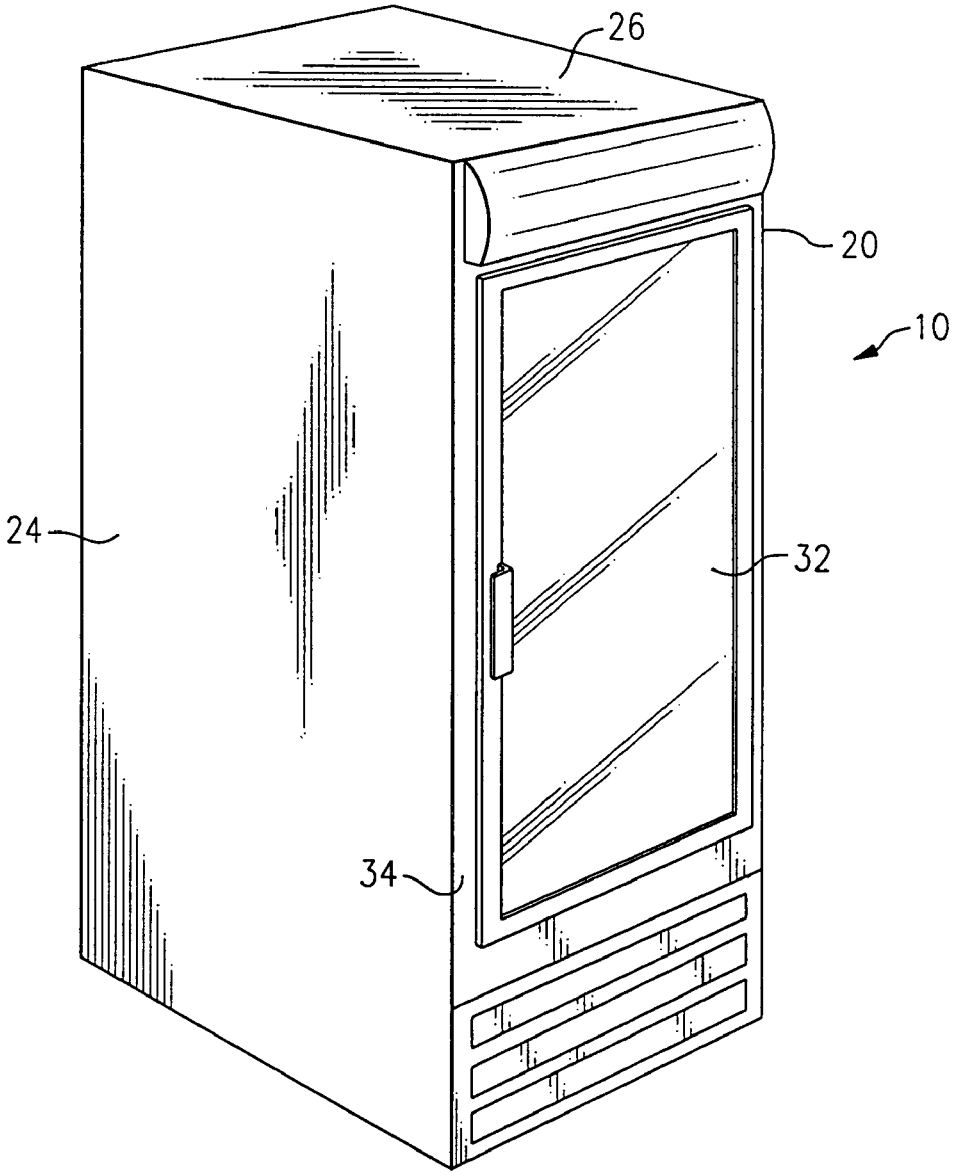
FIG.1 Prior Art
FIG. 1 is a perspective view of a refrigerated beverage merchandiser in accordance with the prior art.
Figure 2:
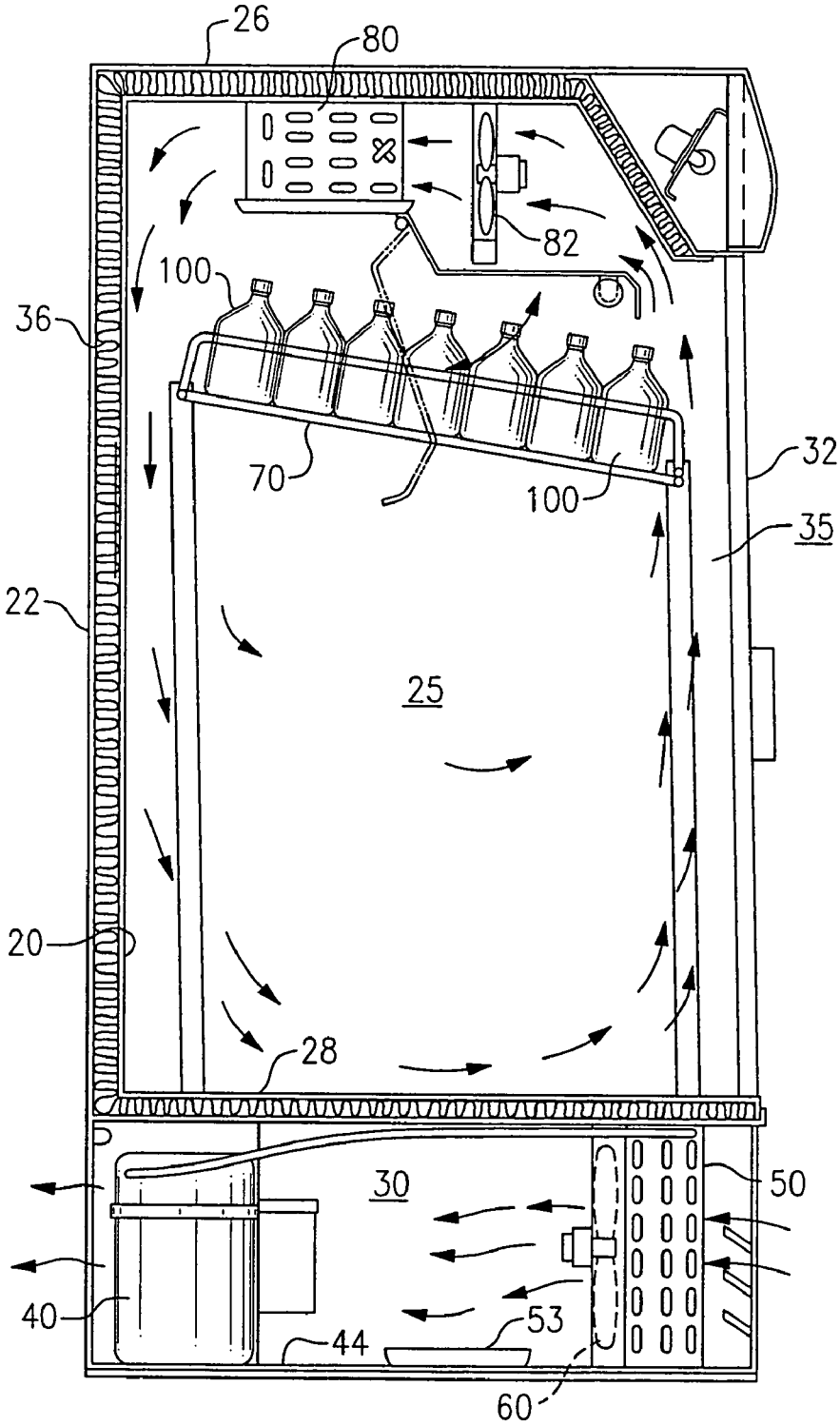
FIG.2 Prior Art
FIG. 2 is a sectional, side elevation view of the refrigerated beverage merchandiser showing the evaporator and condenser sections thereof.

Referring now to FIGS. 1 and 2, there is depicted therein a refrigerated cold beverage merchandiser generally designated by the numeral 10. The beverage merchandiser 10 includes an enclosure 20 defining a refrigerated display cabinet 25 and a separate utility compartment 30 disposed externally of and heat insulated from the refrigerated display cabinet 25. The utility compartment may be disposed beneath the refrigerated display cabinet 25 as depicted or the utility compartment may be disposed above the display cabinet 25. A compressor 40, a condenser coil 50, a condensate pan 53 and an associated condenser fan and motor 60 are housed within the compartment 30. A mounting plate 44 may be disposed beneath the compressor 40, the condenser coil 50, and the condenser fan 60. Advantageously, the mounting plate 44 may be slidably mounted within the compartment 30 for selective disposition into and out of the compartment 30 in order to facilitate servicing of the refrigeration equipment mounted thereon.

The refrigerated display cabinet 25 is defined by an insulated rear wall 22 of the enclosure 20, a pair of insulated side walls 24 of the enclosure 20, an insulated top wall 26 of the enclosure 20, an insulated bottom wall 28 of the enclosure 20 and an insulated front wall 34 of the enclosure 20. Heat insulation 36 (shown by the looping line) is provided in the walls defining the refrigerated display cabinet 25. Beverage product 100, such as for example individual cans or bottles or six packs thereof, are displayed on shelves 70 mounted in a conventional manner within the refrigerated display cabinet 25, such as for example in accord with the next-to-purchase manner shown in U.S. Pat. No. 4,977,754, the entire disclosure of which is hereby incorporated by reference. The insulated enclosure 20 has an access opening 35 in the front wall 34 that opens to the refrigerated display cabinet 25. If desired, a door 32, as shown in the illustrated embodiment, or more than one door, may be provided to cover the access opening 35. It is to be understood however that the present invention is also applicable to beverage merchandisers having an open access without a door. To access the beverage product for purchase, a customer need only open the door 32 and reach into the refrigerated display cabinet 25 to select the desired beverage.

An evaporator coil 80 is provided within the refrigerated display cabinet 25, for example near the top wall 26. An evaporator fan and motor 82, as illustrated in FIG. 2, may be provided to circulate air within the refrigerated display cabinet 25 through the evaporator 80. However, the evaporator fan is not necessary as natural convection may be relied upon for air circulation through the evaporator. As the circulating air passes through the evaporator 80, it passes in a conventional manner in heat exchange relationship with refrigerant circulating through the tubes of the evaporator coil and is cooled as a result. The cooled air leaving the evaporator coil 80 is directed downwardly in a conventional manner into the cabinet interior to pass over the product 100 disposed on the shelves 70 before being drawn back upwardly to again pass through the evaporator.

Refrigerant is circulated in a conventional manner between the evaporator 80 and the condenser 50 by means of the compressor 40 through refrigeration lines forming a refrigeration circuit (not shown) interconnecting the compressor 40, the condenser coil 50 and the evaporator coil 80 in refrigerant flow communication. As noted before, cold liquid refrigerant is circulated through the evaporator coil 80 to cool the air within the refrigerated display cabinet 25. As a result of heat transfer between the air and the refrigerant passing in heat exchange relationship in the evaporator coil 80, the liquid refrigerant evaporates and leaves the evaporator as a vapor. The vapor phase refrigerant is then compressed in the compressor 40 to a high pressure, as well as being heated to a higher temperature as a result of the compression process. The hot, high pressure vapor is then circulated through the condenser coil 50 wherein it passes in heat exchange relationship with ambient air drawn or blown across through the condenser coil 50 by the condenser fan 60.

Figure 3:
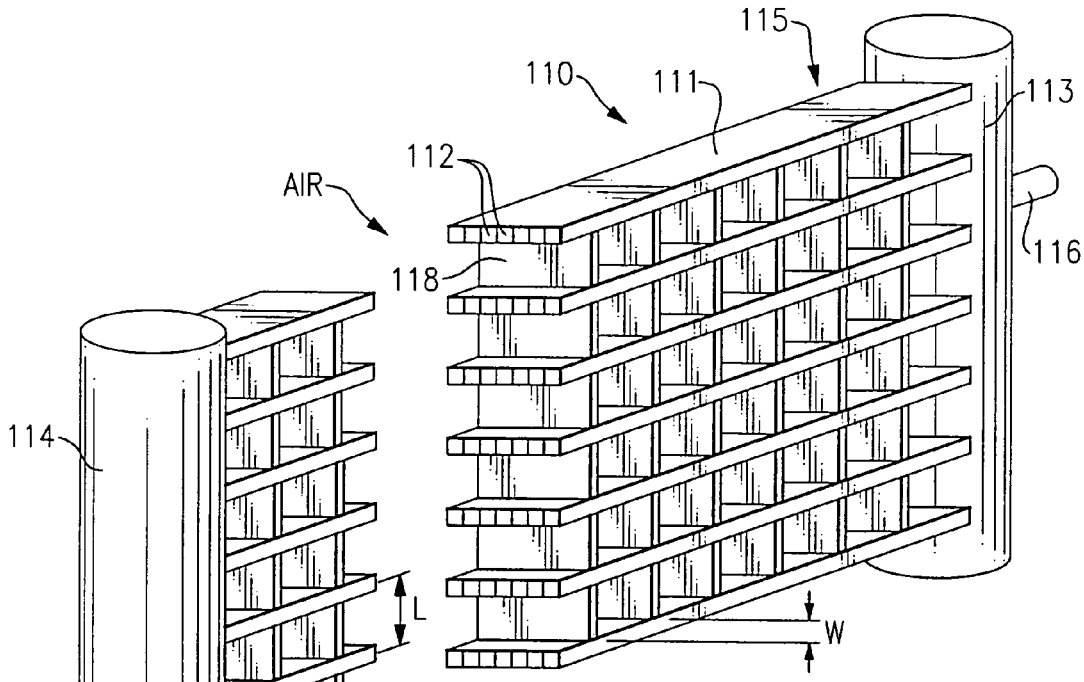
FIG. 3 is a perspective view of a condenser coil in accordance with one embodiment of the present invention.

Referring now to FIG. 3, in accordance with the present invention, the tube and fin condenser coil 50 of FIG. 2 is replaced by a microchannel condenser coil as shown generally at 110. Here, rather than round tubes, a plurality of microchannel tubes 111, having a plurality of parallel channels 112 extending the length thereof, are provided in parallel relationship in a row 115 and are connected at their respective ends by inlet and outlet headers 113 and 114, respectively. An inlet line 116 is provided at the inlet header 113 and the outlet line 117 is provided at the outlet header 114. In operation, the hot, high pressure refrigerant vapor is passed from the compressor into the inlet line 116 where it is distributed to flow, by way of the individual microchannels 112, through each of the microchannel tubes 111 to be condensed to a liquid state. The liquid refrigerant then flows to the outlet header 114 and out the outlet line 117 to the expansion device.

In order to increase the heat exchange capacity of the coil 110, a plurality of fins 118 may be placed between adjacent microchannel tube pairs. These fins are preferably aligned orthogonally to the microchannel tube 111 and parallel with the direction of airflow through the microchannel condenser coil 110. The lateral spacing between adjacent fins is the dimension "W".

One advantage offered by the microchannel tube 111 over the conventional round tubes in a condenser coil is that of obtaining more surface area per unit volume. That is, generally, a plurality of small tubes will provide more external surface area than a single large tube. This can be understood by comparison of a single ⅜ inch (8 millimeter) tube with a 5 millimeter tube. The external surface area-to-volume ratio of the 5 millimeter tube is 0.4, which is substantially greater than that for a 8 millimeter tube, which is 0.25.

One disadvantage to the use of a greater number of smaller tubes rather than fewer larger tubes is that it is generally more expensive to implement. However, the techniques that have been developed for manufacturing microchannel tubes with a plurality of channels has evolved to the extent that they are now economical as compared with the manufacturer and implementation of round tubes in a heat exchanger coil.

Another advantage of the microchannel tubes is that they are more streamlined so as to result in a lower pressure drop and lower noise level. That is, there is much less resistance to the air flowing over the relatively narrow microchannels than there is to the air flowing over relatively large round tubes.

Figure 4:
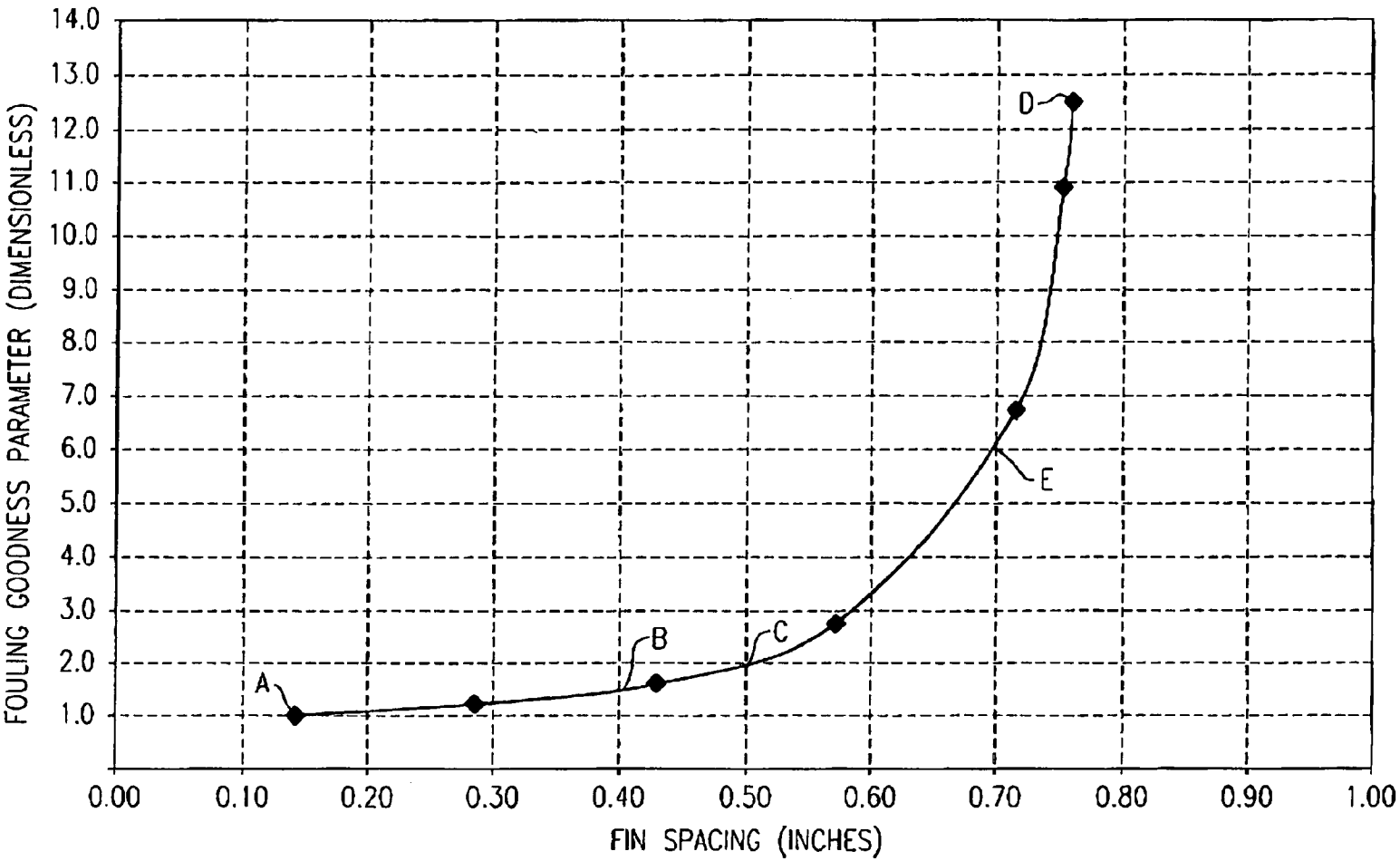
FIG. 4 is a graphic illustration of the relationship between tube/fin density and occurrence of fouling.

Considering now the problem of air side fouling which results from the accumulation of dust, dirt and oils between adjacent tubes and/or adjacent fins of a condenser coil, the applicants have recognized that such a fouling starts with the bridging of an elongate fiber between adjacent tubes or between adjacent fins. That is, most small particles will pass through the passages of a coil unless a passage is somewhat blocked by the lodging of a fiber therein. When a bridging fiber is lodged between adjacent fins or adjacent tubes, then small particles tend to collect on that fiber with the build up eventually resulting in a fouling of the passageway. In order to prevent or reduce the occurrence of fouling, it is therefore necessary to understand the manner in which the bridging effect is influenced by the structural configuration of the coil. With that in mind, the applicants have conducted experimental tests to determine how the variation in the spacing of the tubes and the spacing of the fins can affect the tendency of fouling to occur. The results are shown in FIG. 4.

A field analysis was conducted to determine the types of material that were most likely to cause fouling in the condenser coil, and it was found that cotton fibers were the predominant cause of the foulings and that fouling is generally started by the bridging of an elongate fiber between adjacent fin or between adjacent tubes. Accordingly, experimental analysis was conducted to determine the fouling tendencies of a condenser coil in an environment of cotton fibers as the spacing of the fins is selectively varied. A number of heat exchangers, each being of a standard design with round tubes and plate fins of a specific spacing were exposed to an environment of natural cotton fibers and tested for their relative tendencies to foul. A heat exchanger having seven fins per inch, or a fin spacing of 0.14 inches between adjacent fins, was arbitrarily assigned a fouling goodness parameter (FGP) of 1. This is shown at point A on the graph of FIG. 4.

As the fin spacing is increased, the associated increase in FGP is substantially linear to point B where the spacing is 0.40 inches and the FGP is 1.5. At point C, the relationship is still close to linear wherein the spacing is point 0.50 inches with an associated FGP of 2, which means that the heat exchanger is twice as "good" as compared to the heat exchanger at Point A in regards to fouling.

As the front spacing is increased beyond the 0.50 spacing, it will be seen that the FGP begins to increase substantially beyond the linear relationship, and at a spacing of 0.75 inches as shown at point B, it approaches an asymptotic relationship. Thus, it can be concluded that ideally, the fin spacing should be maintained at 0.75 inches or greater if the maximum FGP is desired. At those higher spacing parameters, however, it will be recognized that the exposed surface area is reduced and therefore the heat exchange capability is also reduced. Accordingly, it may be desirable to maintain sufficient fin spacing so as to obtain a sufficiently high FGP while, at the same time, maintaining sufficient density to provide a desired amount of surface area. For example, at point E, a sufficiently high FGP of 6 is obtained with a fin spacing of 0.70 inches between adjacent fins.

Although the experiential data as discussed hereinabove relates to fin spacing on round tube heat exchangers, the applicants believe that the same performance characteristics will be true of fin spacing with a microchannel tubing heat exchanger as shown in FIG. 3 since the principals involving the attachment of elongate fibers will be substantially the same in each case. Further, recognizing that with a microchannel tubing arrangement as shown in FIG. 3, it is possible to eliminate the fins entirely, or to reduce the number such that they are simply provided for support between the microchannel tubes, while at the same time increasing the density of the microchannel tubes to obtain the desired surface area for heat exchange purposes. Such a heat exchanger is shown in FIG. 5.

Figure 5:
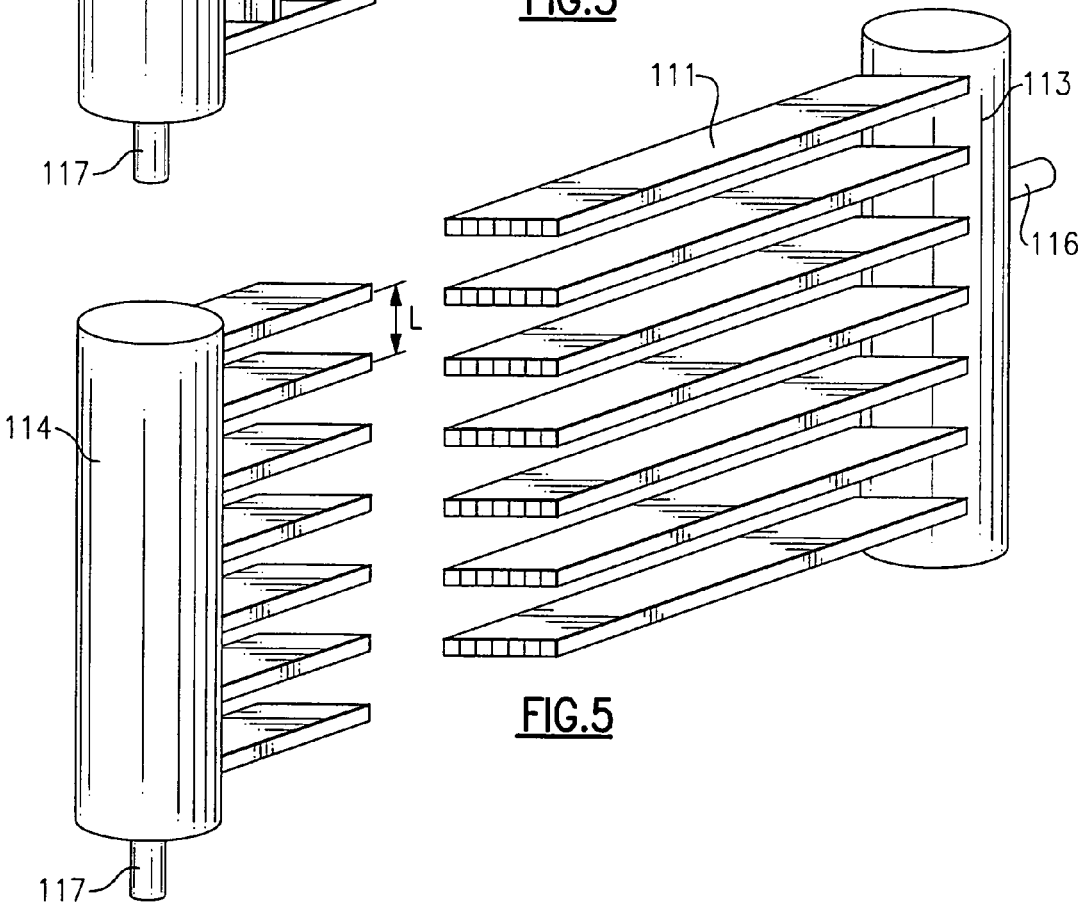
FIG. 5 is a perspective view of an alternative embodiment of a condenser coil in accordance with the present invention.

In the FIG. 5 embodiment, it will be seen that the fins have been eliminated and the microchannel tubes 111 are simply cantilevered between the inlet header 113 and outlet header 114 as shown. With this arrangement, the construction is very much simplified, and the expense of the fins is eliminated. However, the benefit of having the surface area of the fin is also lost for heat transfer purposes. Accordingly, it may be necessary to increase the density of the microchannel tubing 111 such that the distance therebetween, shown as L in FIG. 5 is substantially reduced. In this regard, the considerations discussed hereinabove, with respect to the spacing of fins is also considered to be relevant with respect to the spacing of the microchannel tubes 111. That is, with the spacing L of 0.75 inches, there will be little or no fouling that occurs, and as that fin density is increased, the fouling goodness parameter (FGP) will be decreased or, said in another way, the probability of fouling will be increased.

Figure 6:
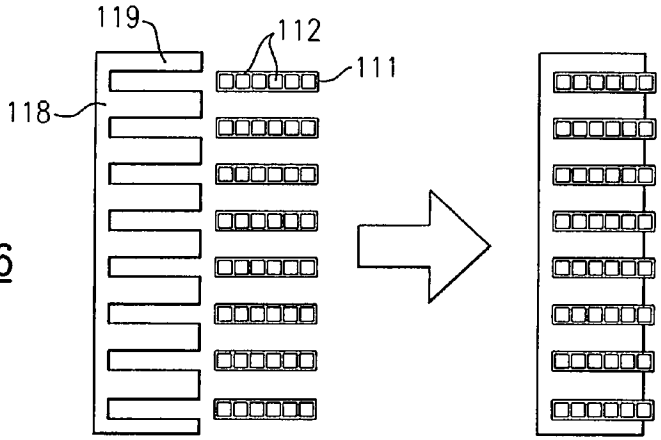
FIG. 6 is a side sectional view of a tube support arrangement in accordance with one embodiment of the invention.
Figure 7:
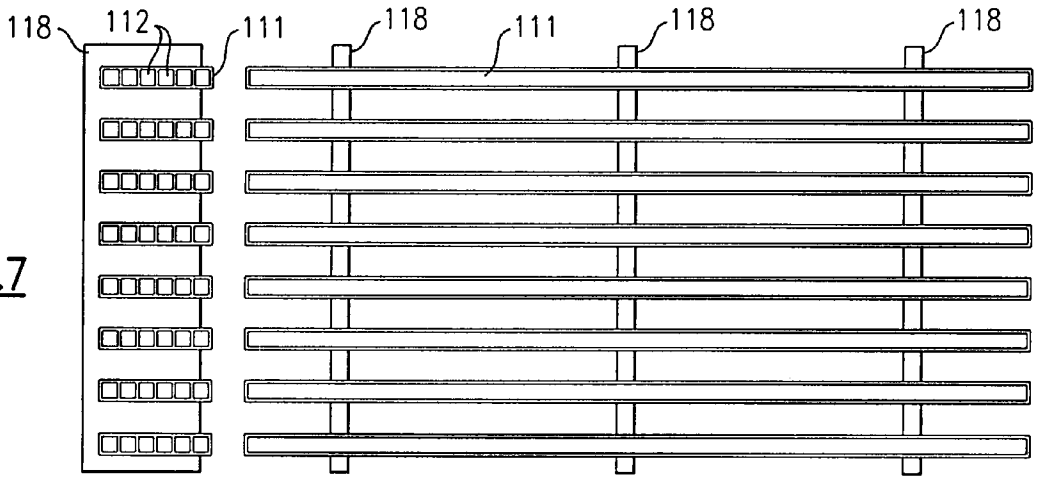
FIG. 7 is a front view thereof.

With the complete elimination of fins as shown in FIG. 5, it may be necessary to provide some support between adjacent microchannel tubes 111, so that both during the manufacture of the heat exchanger and in the finished product, the microchannel tubes 111 are restrained from sagging from their relative parallel positions. Such a support is shown at 118 in FIGS. 6 and 7. In FIG. 6, the support member 118 with its plurality of teeth 119 is shown in the uninstalled position at the left and then in the installed position at the right. In FIG. 7, there is shown in a side elevational view and a front view, three such support members 118 in their installed positions. Such a support member 118 may be fabricated of a heat conductive material so as to not only provide support but also act as a conductor in the same manner as a fin. However, with the significant spacing as shown, so as to not significantly add to the heat conduction surface area, the benefit of the fin effect is minimal. Accordingly, the support members may as well be made of other materials such as a plastic material which will provide the necessary support but not contribute to the function of heat transfer. Here, the spacing of the support members 118 is clearly sufficient such that the lateral space between the support members will not contribute to the bridging of fibers that would cause fouling. Rather, it is only the distance L between adjacent microchannel tubes that will allow for the bridging of fibers therebetween. The considerations discussed with respect to the FIG. 5 embodiment is therefore relevant to the supported embodiment of FIGS. 6 and 7.

Figure 8:
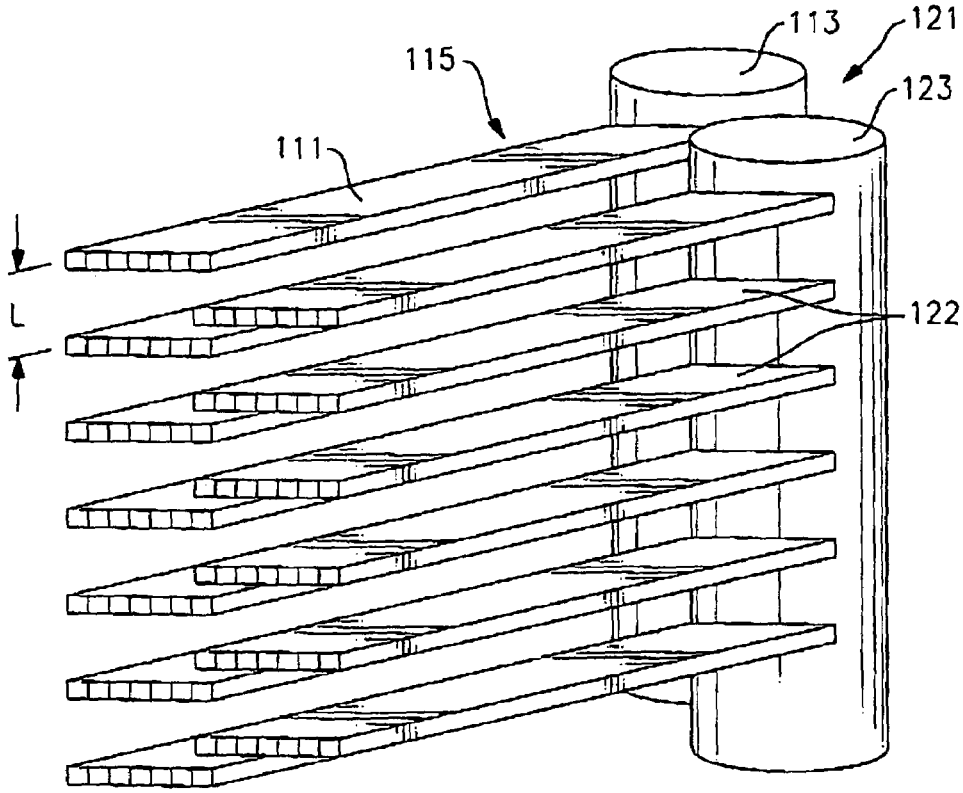
FIG. 8 is an alternative embodiment of the invention showing staggered rows of microchannel tubes.

With the elimination of the fins as discussed hereinabove, another effect that must be considered is that with the resulting reduced heat exchange surface area, and with an associated increase in the density of the microchannel tubes, will there be still sufficient heat exchange surface area to obtain the necessary performance? Presuming that, because of the performance characteristics discussed hereinabove, the spacing L between adjacent microchannels tubes is maintained at around 0.75 inches, the resulting number of microchannel tubes may not be sufficient to bring about the desired amount of heat exchange. One approach for overcoming this problem is shown in FIG. 8 wherein a second row 121 of microchannel tubes 122 is shown with its associated header 123. This will, in effect, double the surface area of the heat exchanger without significantly adding to the problem of fouling between microchannel tubing. While the two rows 115 and 121 of microchannel tubes can be aligned one behind the other in the direction of the airflow, the airflow characteristics can be improved by staggering the two rows such that the tubes 122 of the second row are disposed substantially between, but downstream of, the tubes 111 of the first row 115. With such an arrangement, the controlling parameter with respect to the fouling resistant parameter is still the distance L since this is the distance not only between the individual tubes 111 of the first row 115 but also between the tubes 122 of the second row 121. That is, with such a staggered relationship, there is very little likelihood of a fiber tending to bridge the gap between a tube 111 in the first row 115 and a tube 122 in the second row 121.

It will, of course, be understood that multiple rows of tubes can be placed in such a staggered relationship such that the third row would most likely be aligned with the first row and a fourth row would be most aligned with a second row and so forth. Again, the fouling goodness parameter would not significantly change since the controlling parameter would still be the distance L between tubes in any single row.

While the present invention has been particular shown and described with reference to preferred and alternate embodiments as illustrated in the drawings, it will be understood by one skilled in the art that various changes in detail may be effective therein without departing from the true spirit and scope of the invention as defined by the claims.

We claim:

1. A refrigerated merchandiser comprising:

an enclosure having a front wall partially defining a refrigerated display cabinet and having an access opening in said front wall for providing access to the refrigerated display cabinet;

an evaporator coil disposed in operative association with the refrigerated display cabinet;

a compartment heat insulated from the refrigerated display cabinet;

a condenser coil disposed within said compartment;

a condenser fan disposed within said compartment for circulating air over said condenser coil; and a compressor disposed within said compartment and connected in refrigerant flow communication with said evaporator coil and said condenser coil for circulating refrigerant through said evaporator coil and said condenser coil;

said condenser coil having a plurality of refrigerant carrying tubes aligned in generally parallel relationship in a plane normal to the direction of airflow therethrough and a plurality of fins connected in heat transfer relationship with respective tubes and being in generally parallel relationship in a plane normal to the direction of airflow therethrough;

wherein said plurality of fins are spaced in the range of 0.4 to 0.8 inches between adjacent fins.

2. A refrigerated merchandiser as set forth in claim 1 wherein said plurality of fins are spaced in the range of 0.7 to 0.8 inches between adjacent fins.

3. A refrigerated merchandiser as set forth in claim 2 wherein said plurality of fins are spaced substantially 0.75 inches between adjacent fins.

4. A refrigerated merchandiser as set forth in claim 1 wherein said plurality of tubes are microchannels tubes, each with the plurality of longitudinally extending channels that are fluidly connected at their ends to receive refrigerant vapor flow from a header.

5. A refrigerated merchandiser as set forth in claim 4 wherein said microchannel tubes are spaced in the range of 0.4 to 0.8 inches between adjacent tubes.

6. A refrigerated merchandiser as set forth in claim 4 wherein said microchannel tube as spaced in the range of 0.7 to 0.8 inches between adjacent tubes.

7. A refrigerated merchandiser as set fort in claim 6 wherein said microchannel tubes are spaced substantially 0.75 inches between adjacent tubes.

8. A refrigerated merchandiser comprising:

an enclosure having a front wall partially defining a refrigerated display cabinet and having an access opening in said front wall for providing access to the refrigerated display cabinet;

an evaporator coil disposed in operative association with the refrigerated display cabinet;

a compartment heat insulated from the refrigerated display cabinet;

a condenser coil disposed within said compartment;

a condenser fan disposed within said compartment for circulating air over said condenser coil; and a compressor disposed within said compartment and connected in refrigerant flow communication with said evaporator coil and said condenser coil for circulating refrigerant through said evaporator coil and said condenser coil;

said condenser coil having at least one header for receiving refrigerant vapor from said compressor and having a plurality of microchannel tubes each with a plurality of longitudinally extending channels that are fluidly connected at their ends to receive refrigerant vapor new from said at least one header, said plurality of tubes having generally flat sides that are generally aligned with the direction of airflow thereover and with the spacing between adjacent tubes being in the range of 0.4 to 0.8 inches.

9. A refrigerated merchandiser as set forth in claim 8 wherein said microchannel tubes are spaced in the range of 0.7 to 0.8 inches between adjacent tubes.

10. A refrigerated merchandiser as set forth in claim 9 wherein said microchannel tubes are spaced substantially at 0.75 inches between adjacent tubes.

11. A refrigerated merchandiser as set forth in claim 8 wherein said condenser coil has a plurality of fins connected in heat transfer relationship with respective microchannel tubes and further wherein said fins are spaced such that a distance between adjacent fins is in the range of 0.4 to 0.8 inches.

12. A refrigerated merchandiser as set forth in claim 11 wherein said plurality of fins are spaced at a distance in the range of 0.7 to 0.8 inches between adjacent fins.

13. A refrigerated merchandiser as set forth in claim 12 wherein said fins are spaced at a distance of substantially 0.75 inches apart.

14. A refrigerated merchandiser as set forth in claim 8 wherein said condenser coil includes a second plurality of microchannel tubes with an associated header said second plurality of microchannel tubes being disposed downstream of said first plurality of microchannel tubes.

15. A refrigerated merchandiser as set forth in claim 14 wherein said second plurality of microchannel tubes are staggered in a transverse direction from their alignment of said first plurality of microchannel tubes.

16. A refrigerated merchandiser as set forth in claim 8 wherein said condenser coil has an inlet header and an outlet header each connected to said plurality of said microchannel tubes.

17. A refrigerated merchandiser as set forth in claim 8 and including at least one support member having a plurality of spaced appendages that are disposed individually between adjacent microchannel tubes to provide support therebetween.

18. A refrigerated merchandiser comprising:

an enclosure having a front wall partially defining a refrigerated display cabinet and having an access opening in said front wall for providing access to the refrigerated display cabinet;

an evaporator coil disposed in operative association with the refrigerated display cabinet;

a compartment heat insulated from the refrigerated display cabinet;

a condenser coil disposed within said compartment;

a condenser fan disposed within said compartment for circulating air over said condenser coil; and a compressor disposed within said compartment and connected in refrigerant flow communication with said evaporator coil and said condenser coil for circulating refrigerant through said evaporator coil and said condenser coil;

said condenser coil having a plurality of refrigerant carrying tubes aligned in generally parallel relationship in a plane normal to the direction of airflow therethrough and a plurality of fins connected in heat transfer relationship with respective tubes and being in generally parallel relationship in a plane normal to the direction of airflow therethrough;

wherein said plurality of fins are spaced at a distance of at least 0.4 inches between adjacent fins.

19. A refrigerated merchandiser as set forth in claim 18 wherein said plurality of fins are spaced at a distance of at least 0.6 inches between adjacent fins.

20. A refrigerated merchandiser comprising:

an enclosure having a front wall partially defining a refrigerated display cabinet and having an access opening in said front wall for providing access to the refrigerated display cabinet;

an evaporator coil disposed in operative association with the refrigerated display cabinet;

a compartment heat insulated from the refrigerated display cabinet;

a condenser coil disposed within said compartment;

a condenser fan disposed within said compartment for circulating air over said condenser coil; and a compressor disposed within said compartment and connected in refrigerant flow communication with said evaporator coil and said condenser coil for circulating refrigerant through said evaporator coil and said condenser coil;

said condenser coil having at least one header for receiving refrigerant vapor from said compressor and having a plurality of microchannel tubes each with a plurality of longitudinally extending channels that are fluidly connected at their ends to receive refrigerant vapor now from said at least one header, said plurality of tubes having generally flat sides that are generally aligned with the direction of airflow thereover and with the spacing between adjacent tubes being at least 0.4 inches.

21. A refrigerated merchandiser as set forth in claim 20 wherein the spacing between adjacent tubes is at least 0.6 inches.

22. A refrigerated merchandiser as set forth in claim 20 wherein said condenser coil has a plurality of fins connected in heat transfer relationship with respective microchannel tubes and further wherein said fins are spaced such that a distance between adjacent fins is at least 0.4 inches.

23. A refrigerated merchandiser as set forth in claim 22 wherein said plurality of fins are spaced at a distance of at least 0.6 inches between adjacent fins.

24. A refrigerated merchandiser comprising:

an enclosure defining a refrigerated display cabinet and having an access opening for providing access to the refrigerated display cabinet;

an evaporator coil disposed in operative association with the refrigerated display cabinet;

a condenser coil disposed externally of the refrigerated display cabinet;

a condenser fan disposed in operative association with said condenser coil for circulating air over said condenser coil; and a compressor connected in refrigerant flow communication with said evaporator coil and said condenser coil for circulating refrigerant through said evaporator coil and said condenser coil;

said condenser coil having a plurality of refrigerant carrying tubes arranged in generally parallel relationship, said tubes having generally flat sides that are generally aligned with the direction of airflow thereover, and a plurality of fins connected in heat transfer relationship with respective tubes and being disposed in generally parallel relationship with said plurality of fins being spaced at a distance of at least 0.4 inches between adjacent fins.

25. A refrigerated merchandiser as set forth in claim 24 wherein said plurality of fins are spaced in the range of 0.4 to 0.8 inches between adjacent fins.

26. A refrigerated merchandiser as set forth in claim 24 wherein said plurality of fins are spaced at a distance of at least 0.6 inches between adjacent fins.

27. A refrigerated merchandiser as set forth in claim 24 wherein said plurality of fins are spaced in the range of 0.7 to 0.8 inches between adjacent fins.

28. A refrigerated merchandiser comprising:

an enclosure defining a refrigerated display cabinet and having an access opening for providing access to the refrigerated display cabinet;

an evaporator coil disposed in operative association with the refrigerated display cabinet;

a condenser coil disposed externally of the refrigerated display cabinet;

a condenser fan disposed in operative association with said condenser coil for circulating air over said condenser coil; and a compressor connected in refrigerant flow communication with said evaporator coil and said condenser coil for circulating refrigerant through said evaporator coil and said condenser coil;

said condenser coil having a plurality of refrigerant carrying tubes arranged in generally parallel spaced relationship with said plurality of tubes being spaced at a distance of at least 0.4 inches between adjacent tubes, said tubes having generally flat sides that are generally aligned with the direction of airflow thereover.

29. A refrigerated merchandiser as set forth in claim 28 wherein said microchannel tubes are spaced at a distance of at least 0.6 inches between adjacent tubes.

30. A refrigerated merchandiser as set forth in claim 28 wherein said microchannel tubes are spaced in the range of 0.4 to 0.8 inches between adjacent tubes.

31. A refrigerated merchandiser as set forth in claim 28 wherein said microchannel tubes are spaced in the range of 0.7 to 0.8 inches between adjacent tubes.

* * * * *

UNITED STATES PATENT AND TRADEMARK OFFICE

CERTIFICATE OF CORRECTION

PATENT NO. : 7,000,415 B2
APPLICATION NO. : 10/835031
DATED : February 21, 2006
INVENTOR(S) : Eugene Duane Daddis, Jr. and Robert H. L. Chiang It is certified that error appears in the above-identified patent and that said Letters Patent is hereby corrected as shown below:

Col. 8, I. 47, Claim 8, please delete “new”
Col. 10, I. 5, Claim 20, please delete “now”

Signed and Sealed this

Twenty-ninth Day of August, 2006

JON W. DUDAS
*Director of the United States Patent and Trademark Office*